US006454488B1

(12) United States Patent
Lewis, Sr. et al.

(10) Patent No.: US 6,454,488 B1
(45) Date of Patent: Sep. 24, 2002

(54) ROADWAY ENERGY ABSORBING IMPACT ATTENUATOR

(76) Inventors: David Lewis, Sr., 263 Bradford Dr., Canfield, OH (US) 44406; David Hubbell, 112 Park Ave., Saranuc Lake, NY (US) 12983; William Bryson, 214 W. Pierce St., Easton, PA (US) 18042; William Atwood, Rte. 2 Box 292, Koscivsko, MS (US) 39090

( * ) Notice: Subject to any disclaimer, the term of this patent is extended or adjusted under 35 U.S.C. 154(b) by 0 days.

(21) Appl. No.: 09/498,799

(22) Filed: Feb. 2, 2000

(51) Int. Cl.[7] ..... E01F 9/00
(52) U.S. Cl. ..... 404/6; 404/10; 116/63 R
(58) Field of Search ..... 404/6, 9, 10, 11; 256/13.1; 116/63 R

(56) References Cited

U.S. PATENT DOCUMENTS 3,307,833 A * 3/1967 Muller et al. ..... 256/13.1
3,572,223 A * 3/1971 Vierregger ..... 116/63 R
3,693,940 A * 9/1972 Kendall et al. ..... 256/1
3,717,326 A * 2/1973 Leach et al. ..... 256/13.1
3,845,936 A 11/1974 Boedecker, Jr. et al.
3,856,268 A * 12/1974 Fitch ..... 256/13.1
3,881,697 A * 5/1975 Glaesener ..... 256/13.1
4,175,639 A * 11/1979 Wirt ..... 181/210
4,290,585 A * 9/1981 Glaesener ..... 256/13.1
4,515,499 A * 5/1985 Furiate ..... 404/6
5,011,326 A 4/1991 Carney, III
5,112,028 A 5/1992 Laturner
5,190,394 A * 3/1993 Mallon et al. ..... 404/6
5,660,496 A 8/1997 Muller et al.
5,895,169 A * 4/1999 Holm et al. ..... 404/9
5,988,598 A * 11/1999 Sicking et al. ..... 256/13.1
6,158,379 A * 12/2000 Burlando ..... 116/63 R

* cited by examiner

*Primary Examiner*—Gary S. Hartmann
(74) *Attorney, Agent, or Firm*—Harpman & Harpman

(57) ABSTRACT

An energy absorbing system comprising a plurality of breakaway post elements sequentially spaced to be sheared off by impact of a vehicle. Each post element individually absorbs and decelerates the impacting vehicle at a pre-determined rate that in multiple successive impacts slows the vehicle to a stop before the barrier or to an acceptable speed within the design requirements for impact with a barrier.

5 Claims, 4 Drawing Sheets

ROADWAY ENERGY ABSORBING IMPACT ATTENUATOR

BACKGROUND OF THE INVENTION

1. Technical Field

This invention relates to energy absorption apparatus for preventing a vehicle from unrestricted impacting of a stationary roadside structure. More specifically, this invention relates to the de-acceleration of a vehicle by an energy absorbing device before it reaches a stationary structure. Such energy absorbing apparatus include impact attenuation barriers and support elements for roadway signs and the like. Support elements of this nature are characterized by break-away posts having approved shear impact characteristics that meet the vehicle de-acceleration requirements upon impact as having certain engineering design requirements as per The American Association of State Highway and Transportation Officials (AASHTO) and the FHWA's Manual of Uniform Traffic Control Devices (MUTCD) and other design codes' requirement.

In addition, in evaluating impact attenuation systems, certain tests performance levels have been established by the federal government including the NCHRP 350 test 1, 2 and 3. Each of these test requirements of performance of vehicles impacting attenuation barrier include independent and interdependent crash performance perimeters with the primary performance characteristic requirement of an acceptable de-acceleration rate of the crash vehicle. Support elements for a roadway sign are evaluated for their break-away characteristics having been tested and approved so as to meet maximum de-acceleration rates of a vehicle upon such impact.

2. Description of Prior Art

A number of prior art devices are directed towards the problem of energy absorption of a vehicle impact with a stationary structure such as bridge abutments, parapets, traffic elements and rigid guard rails. Many of such devices provide a collapsible structure of inner engaging deformable elements such as overlying guardrail sections, honeycomb structures and crushable enclosures filled with energy absorption material.

All of such devices must meet government performance standards as in the National Cooperation Highway Research Program, NCHRP, Department 350 by the National Research Commission. These standards are directed towards the safety performance evaluation of highway features for longitudinal barriers, terminals and crash cushions, support structures, work zone traffic, central devices and utility poles.

A variety of impact attenuation systems have been developed, see for example U.S. Pat. Nos. 3,845,936, 5,660,496, 5,112,028 and 5,011,326. All of the above prior art patents rely on the energy absorption properties of material deformation and energy absorption and elaborate structural configurations placed in front of stationary barriers to be protected.

SUMMARY OF THE INVENTION

The present invention is directed towards energy absorption devices that dissipate impact forces of a vehicle before it reaches a roadway object by use of multiple break-away posts elements. Such post elements meets FHWA approval for break-away characteristics which include an acceptable meters per second de-acceleration rate of the vehicle as it impacts energy absorption device. The plurality of such posts elements are arranged to sequentially engage the vehicle wherein each posts incrementally de-accelerates the vehicle at a known rate from the initial post impact to the final vehicle resting point. Preferably the apparatus of the invention includes multiple posts extending from a central mounting base which is in turn buried in the foreground of the structure to be protected.

DESCRIPTION OF THE PREFERRED EMBODIMENT

Figure 1:
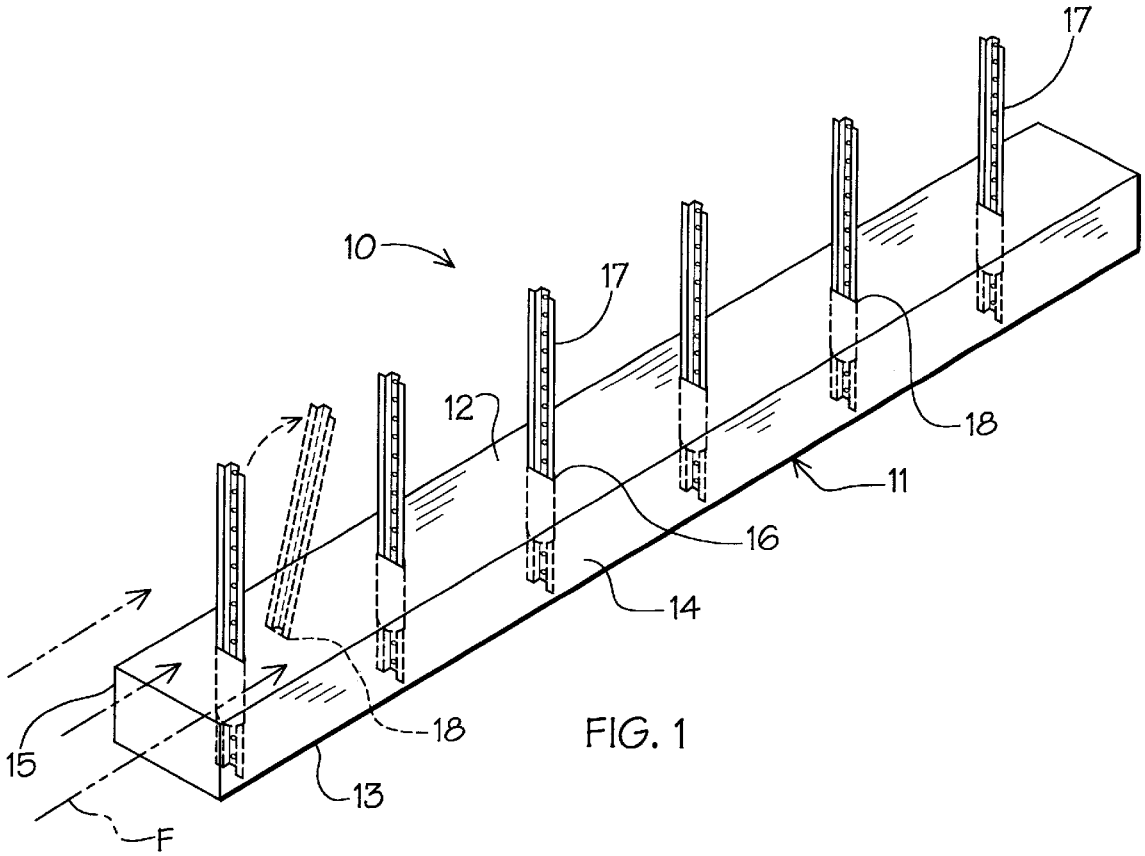
FIG. 1 is a perspective view of the preferred embodiment of the invention.
Figure 2:
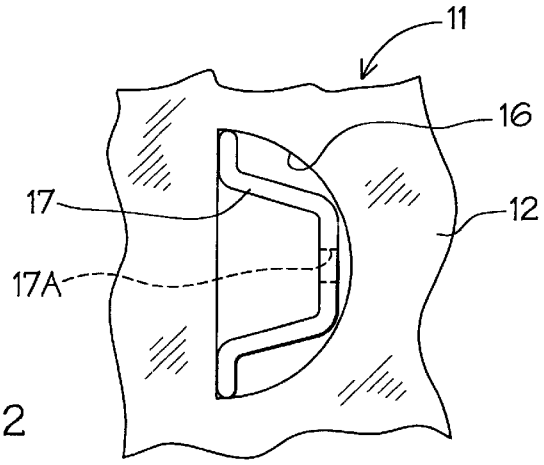
FIG. 2 is an enlarged partial top plan view of a post and mounting opening as seen in FIG. 1.
Figure 3:
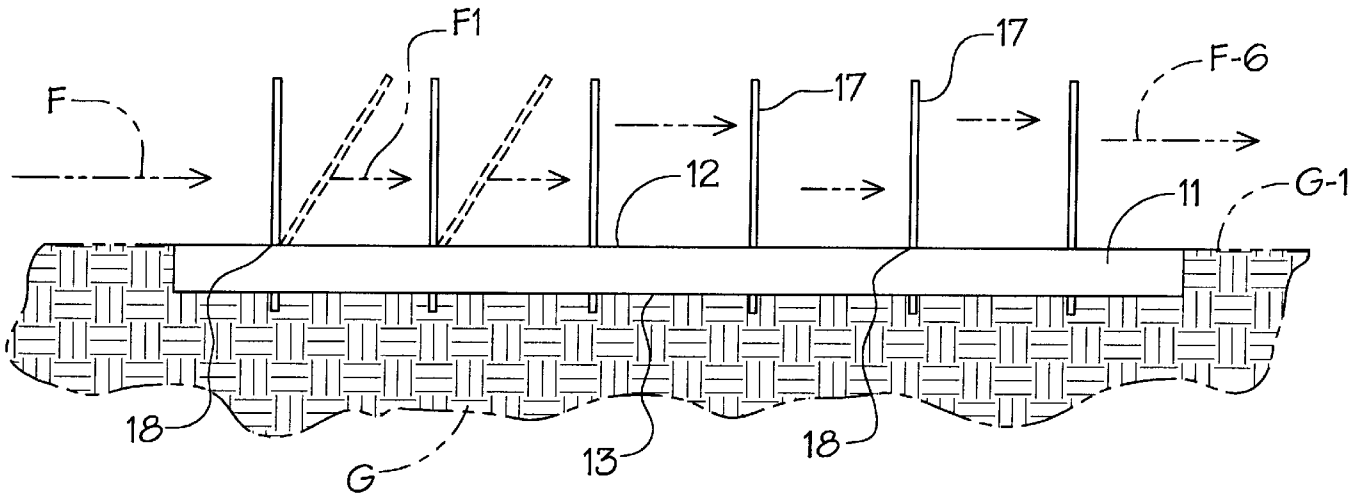
FIG. 3 is a side elevational view of the invention deployed in the ground.
Figure 4:
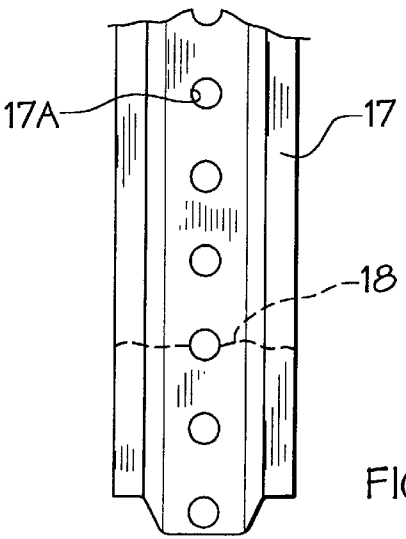
FIG. 4 is an enlarged partial front elevational view of a post of the invention.

Referring now to FIGS. 1, 2 and 3 of the drawings the preferred embodiment of the energy impact posts system 10 (EIPS) can be seen. The (EIPS) 10 is designed and adapted to attenuate and dissipate the energy of an impacting vehicle, thus preventing the vehicle colliding unimpeded with a roadway barrier B. The (EIPS) 10 includes an elongated base element 11 which in this example chosen for illustration is of a monolithic synthetic resin (plastic) composition. The base element is cross-sectionally rectangular having an elongated top and bottom surface areas 12 and 13 and respective elongated side surfaces 14 and 15. A plurality of longitudinally spaced mounting apertures 16 extend through the base element 11 and its top and bottom surface areas 12 and 13. A corresponding number of post elements 17 are registerable within the respective aperture 16. Each of the post elements 17 is of a "break-away" structural dimension having a plurality of spaced apertures 17A within as best seen in FIG. 4 of the drawings and are designed to meet approved U.S. Federal Highway Administration safety requirements for such break-away devices.

The post element 17 chosen for illustration is a standard three pound/foot (3 lb. per—foot) apertured U-channel configuration that is by its very nature a "break-away" post without the addition of any other performance components.

The post elements 17 are of a sufficient length that they extend through the respective apertures 16 in the base element 11 with a substantial impact area extending beyond the top surface area 12 and the remaining portion of the posts extending marginally from the bottom surface 13. The apertures 16 in the base element 11 are shaped so as to impart a high frictional interference with the post element 17 as it is inserted therethrough thus holding the post element 17 securely within as best seen in FIG. 2 of the drawings. It will be apparent to those skilled in the art that other aperture configurations can be used as long as a surface interference is maintained with the post selected for insertion therein.

Referring now to FIG. 3 of the drawings, the assembled (EIPS) 10 of the invention is shown in use being buried in the ground G so that the top surface area 12 is at ground level G-1 with the post element 17 extending thereabove the top surface 12 and marginally below the bottom surface 13 so as to ensure the post break-away characteristics can be achieved upon impact by maintaining a secure mounting area within the base 11 and ground.

Figure 7:
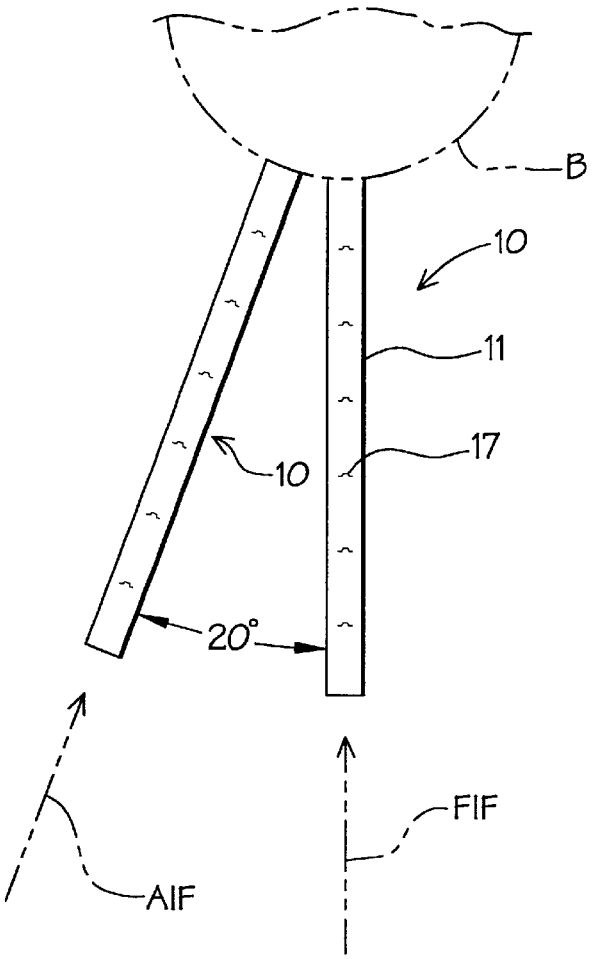
FIG. 7 is a graphic illustration of a preferred embodiment of the invention in a typical installation on a barrier shown in broken lines.

A vehicle force F illustrated by the broken lines arrow in FIGS. 1, 3 and 7 impacts the exposed post element 17 above the surface 12 in a sequential manner shearing the post off at 18 reducing the vehicle's force F to F–1. As subsequent post elements 17 are impacted and sheared off, incremental force reduction is achieved to a maximum level of F–6 as illustrated in FIG. 3 of the drawings.

In this environment, vehicle force F is related to vehicle (speed) and by impacting with each of the post elements 17 a given speed reduction is achieved reducing the vehicle's force F to the illustrated value of F–6.

Since the FHWA approved post element 17 used will not exceed the five meter per second de-acceleration rate required during impact, it will correspondingly reduce the overall speed of the vehicle (vehicle force) by a proportional amount for a given vehicle weight upon sequential impact.

It will be evident from the above description that different placement patterns and numbers of post elements 17 can be used to meet different vehicle force requirements such as F+1 and F+2 corresponding to increased weight of vehicles (not shown).

Figure 9:
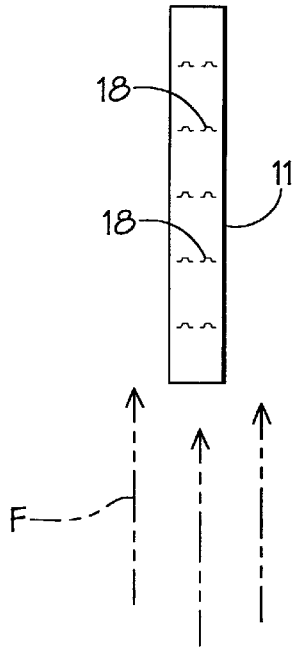
FIG. 9 is an alternate form of the invention illustrating pairs of posts and aligned engagement arrangement.
Figure 8:
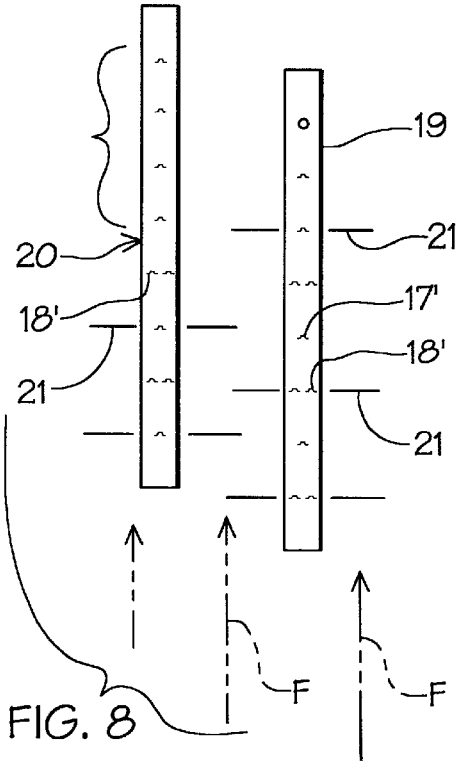
FIG. 8 is an illustration of an alternate deployment of the invention with select posts arrangement.

Referring now to FIGS. 8 and 9 of the drawings, alternate post placement and numbers are illustrated to address different vehicle force requirements. In FIG. 9 of the drawings, pairs of post elements 18 extend from a mounting base 11'. In FIG. 8 of the drawings, a mix of post elements 18 in pairs 18' on two spaced and staggered support bases 19 and 20. The alignment of the selected posts 18 and post pairs 18' between the adjacent support bases 19 and 20 maintain a staggered impact field as illustrated by the alignment lines 21 so that only one set or individual post element 18 is engaged in a sequential fashion by the vehicle force F indicated by broken arrow lines.

Referring to FIG. 7 of the drawings, a typical application is illustrated wherein a pair of (EPS) 10's are deployed in front of a roadway barrier B to meet safety requirements for a front impact force FIF and an angled impact force AIF. Such angle of inclination is determined by government regulations to be specifically twenty degrees spacing therebetween.

Figure 5:
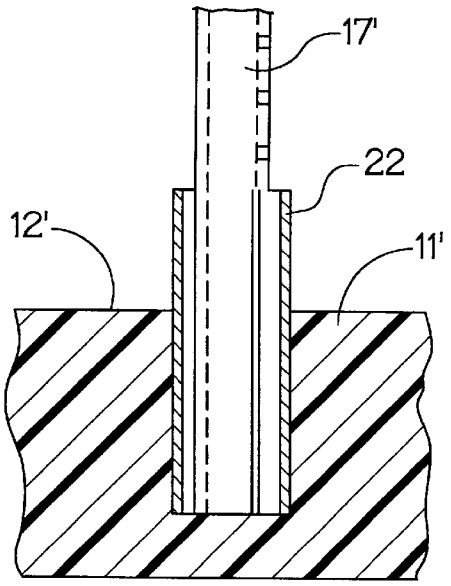
FIG. 5 is a partial cross-sectional view of an alternate mounting system for the post of the invention.
Figure 6:
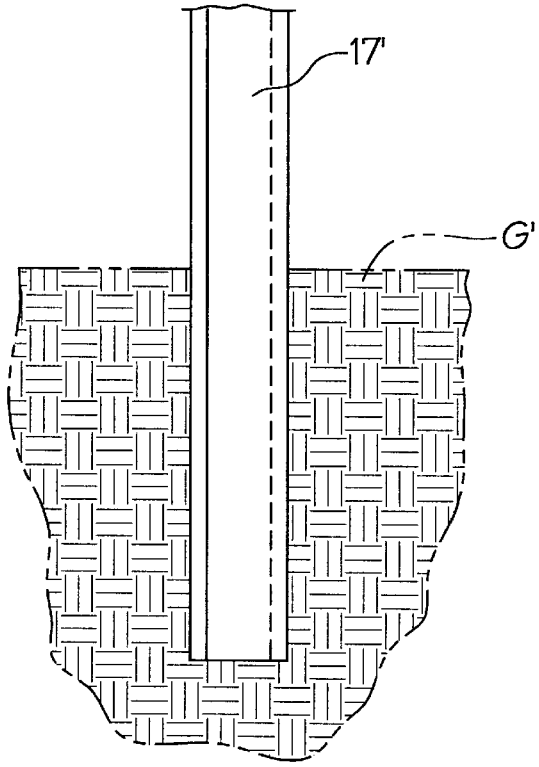
FIG. 6 is an alternate mounting system for the posts of the invention showing it being placed directly in the ground.

Alternate post mounting systems can be seen in FIGS. 5 and 6 of the drawings. In FIG. 5 of the drawings a support socket 22 is embedded partially within a base element 11'. The socket 22 extends from the top surface 12' for receiving a standard U-shaped post element 17' within.

In FIG. 6 of the drawings, a post element 17' is driven directly into the ground G'. The alternate mounting system's performance is dependent on the ground G' density. Such a ground base support system would still have linear space posts as set forth in the preferred embodiment so that sequential impact of the ground driven post can be achieved by the vehicle force F. The flexibility of such a ground engagement post 17 affords that different posts placement patterns can be achieved that will not depend on the longitudinal base support members 11 and 11' as hereinbefore disclosed.

It will be apparent that by the use of multiple "break-away" post elements 17 and 17" and 18 in linear sequential placement patterns, that during impact the vehicle force F will be diminished upon each post impact. Such vehicle force F reduction will slow the vehicle down to meet government standards for stationary barriers B impact as hereinbefore discussed.

It will therefore be seen that a new and novel impact energy absorption system has been illustrated and described and that it will be apparent to those skilled in the art that various changes and modifications may be made without departing from the spirit of the invention.

We claim:

1. An energy impact absorbing apparatus comprising a plurality of linearly aligned longitudinally spaced post elements that break away upon application of lateral impact force, said post elements are of a uniform length, a support base for said post elements, comprises an elongated monolithic member of uniform width buried in ground, said post elements extending through said support base into the ground, means for securing said post elements through said support base, said linearly aligned post elements arranged in a selective pattern for sequential linear and subsequent axial impact force engagement, each of said post having a known shear force during axial impact.

2. The energy impact absorbing apparatus set forth in claim 1 wherein said elongated monolithic member is composed of synthetic resin material.

3. The energy impact absorbing apparatus set forth in claim 1 wherein said means for securing said post elements through said support base comprises; a plurality of longitudinally spaced apertures in said base member in which said respective post elements are registerably engaged.

4. The energy impact absorbing apparatus set forth in claim 1 wherein said post elements are made of metal hang a plurality of apertures within.

5. The energy impact absorbing apparatus set forth in claim 1 wherein said post elements are arranged in spaced longitudinally aligned relation to one another in said support base.

* * * * *